US006120603A

United States Patent [19]

Bryant

[11] Patent Number: 6,120,603

[45] Date of Patent: Sep. 19, 2000

[54] ADHESIVE VISCOUS LIQUID SCREED

[75] Inventor: Timothy D Bryant, Gloucester, Va.

[73] Assignee: Face International Corp.

[21] Appl. No.: 09/108,510

[22] Filed: Jul. 1, 1998

[51] Int. Cl.[7] ..... B05C 5/00

[52] U.S. Cl. ..... 118/410; 118/415

[58] Field of Search ..... 118/410, 415; 425/87, 113, 12

[56] References Cited

U.S. PATENT DOCUMENTS

| | | | |
|---|---|---|---|
| 2,273,599 | 2/1942 | Smith et al. | 425/87 |
| 3,957,406 | 5/1976 | Battersby | 425/87 |
| 5,615,973 | 4/1997 | Campbell | 404/75 |

*Primary Examiner*—Laura Edwards

*Attorney, Agent, or Firm*—Stephen E. Clark; David J. Bolduc

[57] ABSTRACT

An adhesive viscous liquid screed for dispensing a uniform thickness of an initially viscous liquid material onto a planar work surface in order to produce a film of predetermined thickness, length and width. The screed engages a planar horizontal application surface and a reservoir is filled with a liquid adhesive. As the screed is propelled forward along the application surface, the pressure on the adhesive due to gravity causes it to be forced out of the reservoir and through a first release orifice, thereby depositing a thin film of liquid adhesive. The height of the film is determined by the distance between the application surface and the bottom surface of a rib defining the release orifice and the width of the film is determined by the distance between the substantially vertical sides of the first release orifice.

8 Claims, 6 Drawing Sheets

ADHESIVE VISCOUS LIQUID SCREED

BACKGROUND OF THE INVENTION

1. Field of Invention

The present invention relates to tools used in the manufacture of thin films. In particular, the present invention relates to a device for dispensing a uniform thickness of an initially viscous liquid material onto a planar work surface in order to produce a film of predetermined thickness, length and width. This thin film of viscous liquid material is then further processed to create a solid film of adhesive material.

2. Description of the Prior Art

Methods have been employed to spread and distribute materials such that a layer of uniform thickness of that material may be spread on a surface. "Doctoring blades" are generally known to accomplish this function. The material is typically placed onto an application surface, and a doctoring blade is passed over the material to spread it into a layer or film of uniform thickness. The doctoring blade consists of a bar or spreader mounted on wheels that support the bar above the application surface. The bar may be adjustably mounted on the wheels so that the elevation of the bar above the work surface may be varied. As the doctoring blade is rolled across the material on the application surface, the bar spreads the material into a layer of uniform thickness.

A problem with prior doctoring blades is that while they are suitable for defining the thickness of distribution for some types of materials, they are not readily suitable for creating a thin uniform film of an adhesive viscous liquid. When spreading an adhesive viscous liquid onto an application surface, the spreader and the wheels of the doctoring blade become coated and clogged with the adhesive and require cleaning. Cleaning and maintenance of such prior apparatus can cause undesirable downtime in the production of adhesive thin films.

When the spreader of the doctoring blade becomes coated with the adhesive, the coating can affect the relative height of the spreader in relation to the wheels of the doctoring blade. This can produce a film of adhesive that is not of the desired thickness. Also, when the adhesive has collected on the spreader unevenly, it can undesirably affect the uniformity of the thickness of distribution of the adhesive viscous liquid.

When the wheels of the doctoring blade become clogged (e.g., by the adhesive), it restricts the smooth travel of the doctoring blade across the application surface, affecting the uniformity of the distribution of the adhesive viscous liquid. Additionally, when the wheels of the doctoring blade have been coated, it also affects the relative height of the spreader in relation to the application surface, undesirably increasing the thickness of the film of adhesive viscous liquid.

It is also known that with some doctoring blades, the option exists to increase the distance between the wheels of the doctoring blade. This however also causes an undesirable non-uniform distribution of the adhesive viscous liquid because as the wheels are moved further apart, the spreader may sag in the middle. This undesirably causes the sides of the distributed film to be of greater thickness than the center of the film of adhesive viscous liquid.

Screeds are also generally known. Typically a screed consists of a leveling bar which is passed over a wet concrete form to level the concrete. The form consists of horizontal bars which contain the wet concrete (as for the sides of a sidewalk) defining not only the width of the concrete, but also the maximum height of the concrete. As a screed is passed over the form, the concrete is distributed evenly within the form's boundaries, and excess concrete is removed by the screed such that the plane formed between the top edges of the form defines the height of the concrete. Also known is a paving device using a screed wherein the paving material is supplied through a gravity fed hopper. This is the subject of U.S. Pat. No. 5,615,973 to Campbell.

Such prior screeds are not suitable for spreading films of adhesive viscous liquids. The manufacture of forms of varying lengths and thinness is not suitable for the production of a film of adhesive viscous liquid, which is typically very thin. Additionally, the adhesive viscous liquid can coat the surfaces of the form and leveling bar, creating an undesirable lack of uniformity in the thickness and width of the film of adhesive viscous liquid.

Another problem with both doctoring blades and screeds is that it is difficult to accurately measure the precise amount of material needed to create a layer or film of predetermined length. With a doctoring blade, an approximate amount of material is spread on the application surface and is then distributed on the surface by passing the doctoring blade over the material. When applying a film of adhesive viscous liquid with a doctoring blade, the excess adhesive not only coats and clogs the surfaces of the doctoring blade but also may go to waste.

With a screed such as one incorporated in a paving apparatus, an approximate amount of paving material is placed within the form, and the excess material is removed. Screeds of this configuration, when used to create a thin film of adhesive viscous liquid not only become coated with excess adhesive, but may also allow the excess to go to waste.

Another problem is that both screeds and doctoring blades require a separate means to convey and dispense the material to be distributed. The requirement of conveyance and dispensing means makes screeds and doctoring blades operable only in conjunction with large, supplemental equipment. Screeds used in the creation of level pavement or roads are used in conjunction with cement trucks, large hoppers, and conveyors which are hydraulically, pneumatically or electrically operated. Doctoring blades typically distribute materials fed through them by conveyor belts. These screeds and doctoring blades thus are not suitable for manual or hand-held operation because of the requirement for separate conveyance means.

SUMMARY OF THE INVENTION

The term "screed" is here applied to a device that delivers an adhesive viscous liquid onto an application surface as a thin film of a predetermined length, width and thickness.

Accordingly, it is a primary object of the present invention to provide a device for producing a thin sheet of an adhesive viscous liquid of uniform thickness.

It is a further object of the present invention to provide a device of the character described that does not require separate conveyance for the adhesive viscous liquid.

It is a further object of the present invention to provide a device of the character described having means for temporarily containing the liquid to be delivered to an application surface.

It is a further object of the present invention to provide a device of the character described that can be formed from a single rigid material.

It is a further object of the present invention to provide a device of the character described having means for dispensing the liquid to the application surface.

It is a further object of the present invention to provide a device of the character described that is hand-held and manually operable.

It is a further object of the present invention to provide a device of the character described that can be easily maintained and cleaned.

It is a further object of the present invention to provide a device of the character described that further produces a sheet of predetermined length and width.

It is a further object of the present invention to provide a device of the character described that minimizes waste of any excess adhesive.

Further objects and advantages of the invention will become apparent from a consideration of the drawings and ensuing description thereof.

DESCRIPTION OF THE PREFERRED EMBODIMENT

A thin sheet of an adhesive viscous liquid of uniform thickness can be produced with a device constructed in accordance with the following disclosure and by following the operation described below.

To facilitate understanding the present invention, the following disclosure describes a novel device which may be propelled in a "forward" direction across a substantially planar horizontal application surface in order to apply a film to that surface. Accordingly, the words "up", "down", "vertical" and cognate terms refer to directions perpendicular to the plane of the film produced; the words "horizontal", "forward", "longitudinal" and cognate terms refer to directions parallel to the plane of the film to be produced; and the words "left", "right", "transverse" and cognate terms refer to directions perpendicular to "longitudinal" and parallel to the plane of the film to be produced.

Figure 1:
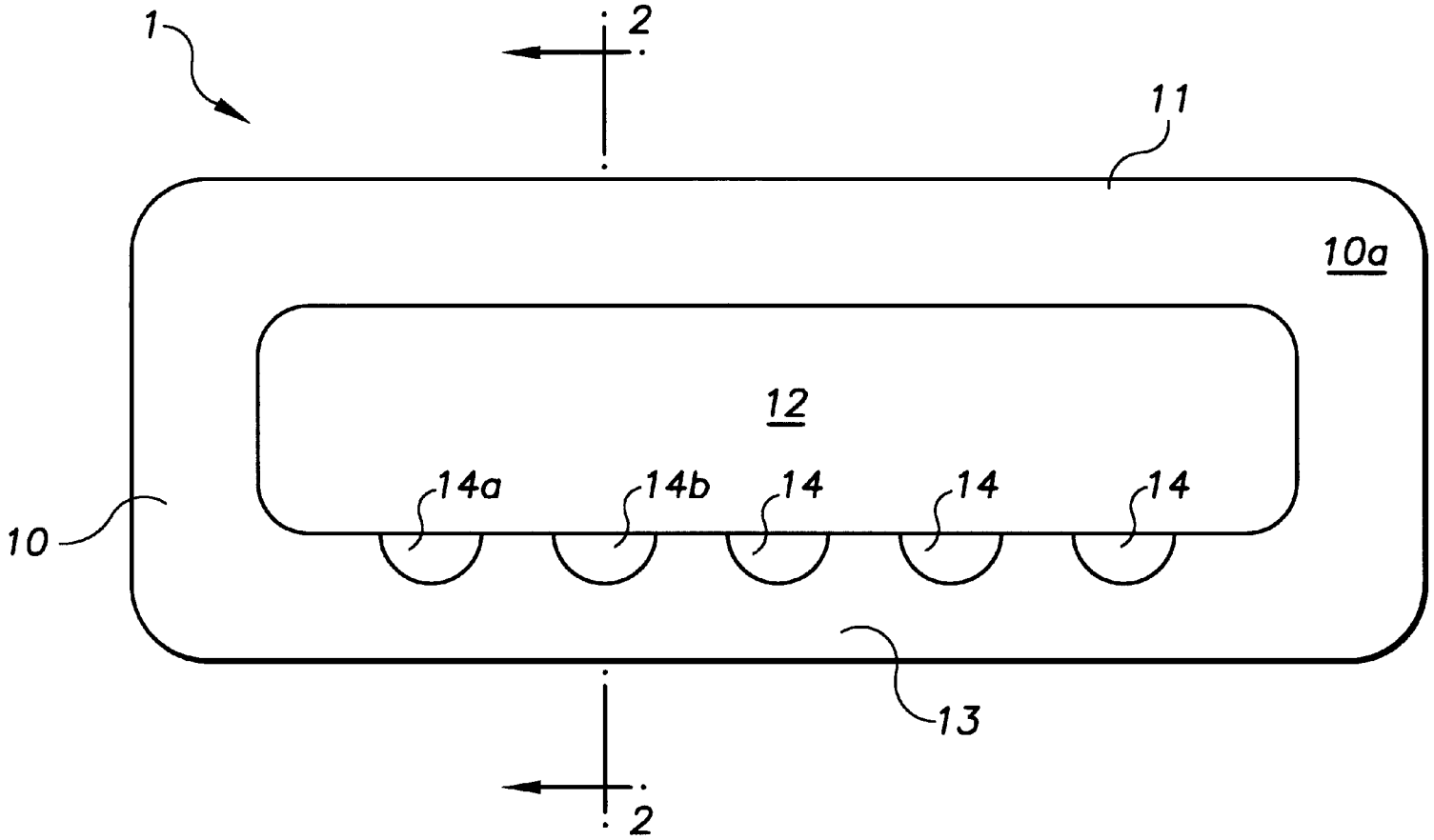
FIG. 1 is a plan view of the screed used in the preferred embodiment of the present invention.
Figure 4:
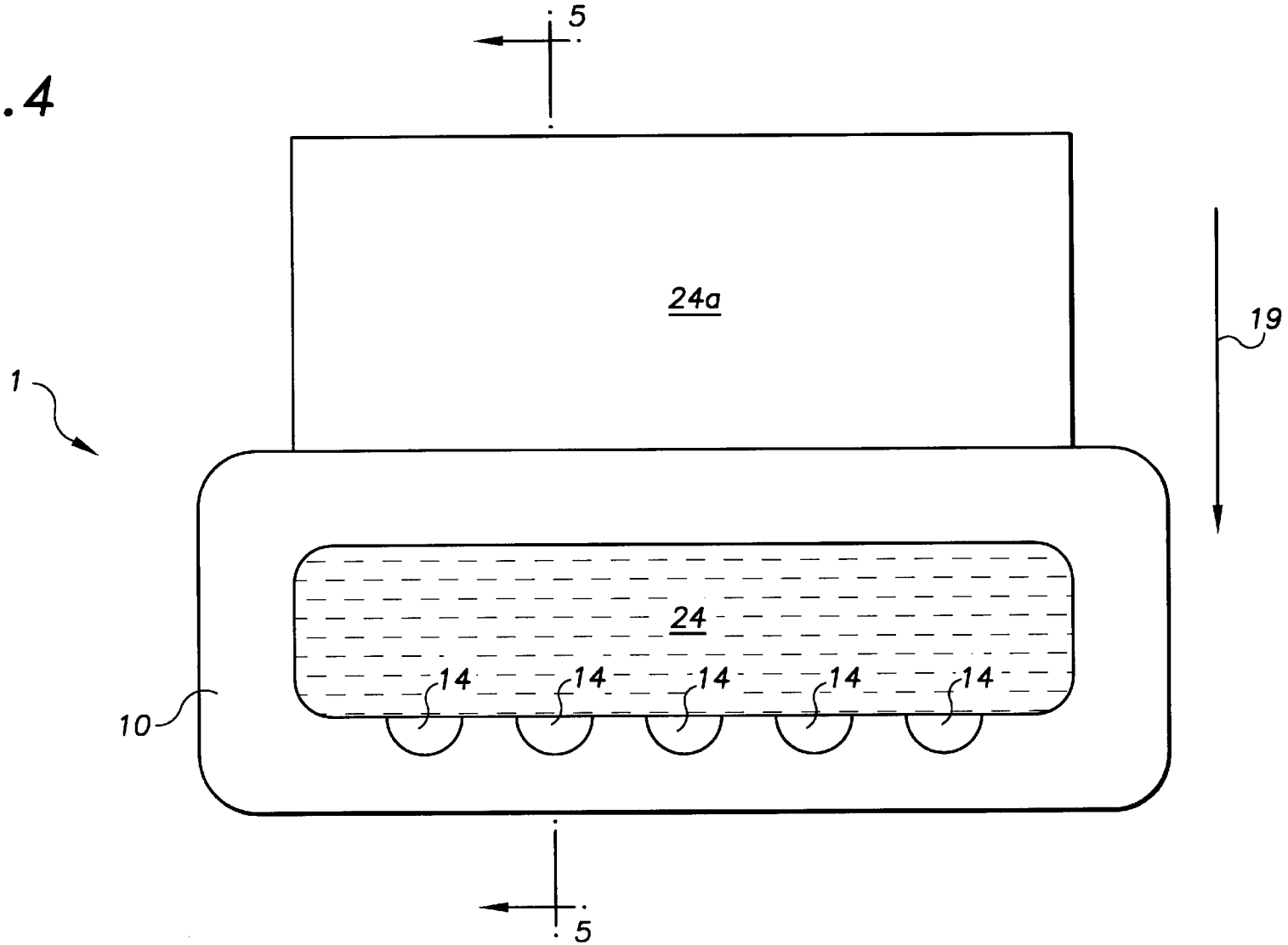
FIG. 4 is a plan view of the screed shown in FIG. 1 in operation.

FIGS. 1 and 4 show a viscous liquid screed (generally designated 1 in the figures) used in the preferred embodiment of the present invention to apply a thin sheet 24*a* of an adhesive viscous liquid of uniform thickness to an application surface 26. The application surface 26 is preferably flat and may be made of aluminum, stainless steel, ceramic, glass or other firm material. For exemplary purposes only, in the description below, the viscous liquid screed 1 is used to apply a thin sheet of a polyamic acid 24 (such as 4,4'-ODPA, 3,4,3',4'-BPDA and 3,4'-ODA in an NMP solution) to a glass plate 40. The use of polyamic acid 24 and a glass plate 40 should not be construed as limitations of the present invention, but as one embodiment thereof.

Figure 5:
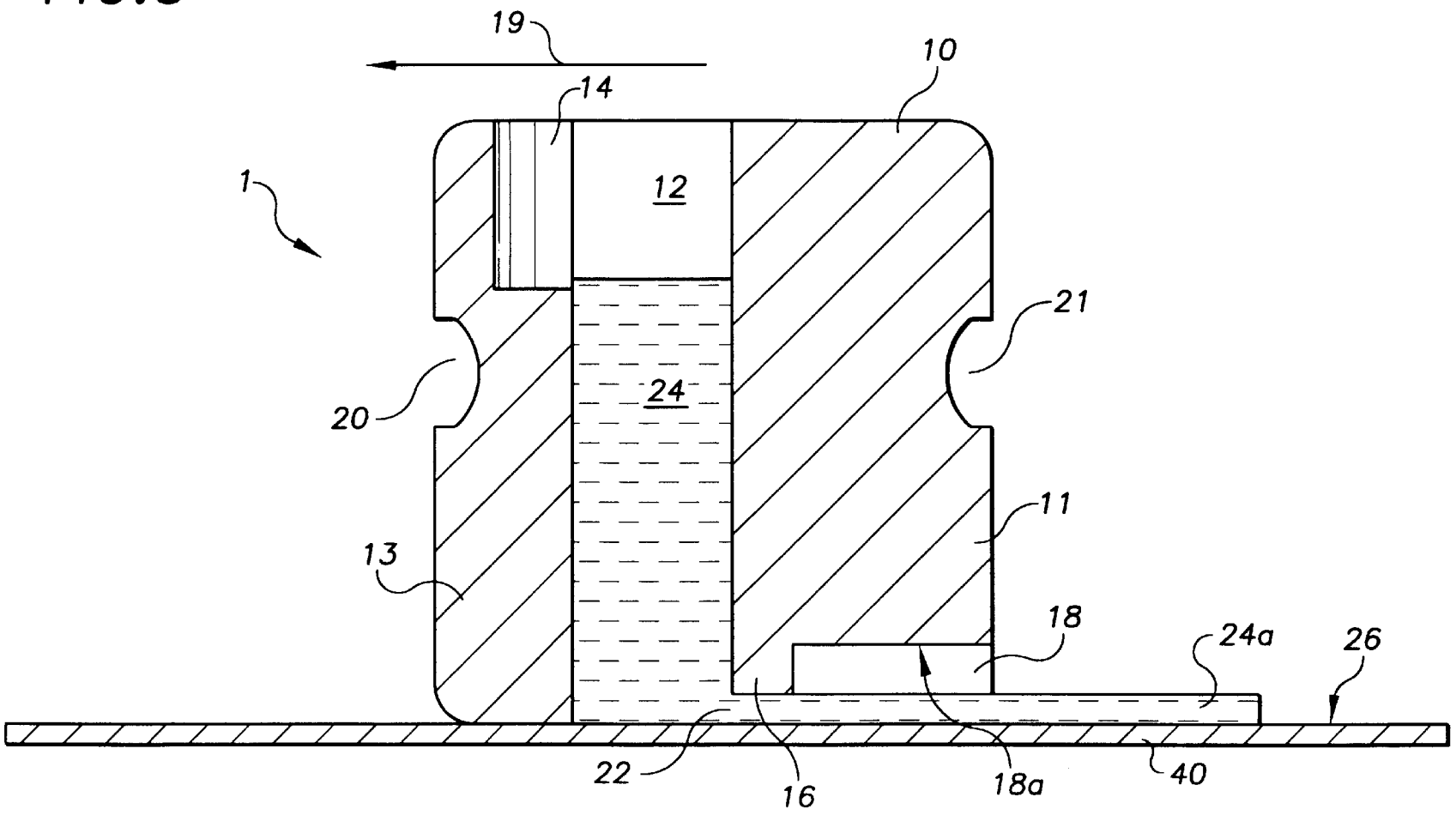
FIG. 5 is a cross sectional view taken along line 5—5 of FIG. 4.

As will be discussed more fully herein below, in operation the screed 1 is first placed upon an application surface 26. A reservoir 12 located in the body 10 of the screed 1 is then filled with polyamic acid 24 to a predetermined level. The screed 1 is subsequently propelled (e.g., manually pulled) across the application surface 26 of the glass plate 40 in a forward direction (designated by arrow 19 in the figures), thus providing a thin film 24*a* of liquid polyamic acid 24 of predetermined length, as shown in FIGS. 4 and 5.

The viscous liquid screed 1 comprises a body 10 which is preferably made of a metal such as aluminum, brass, steel or the like, but which may also be made of a polymer or other material resistant to the solvent used in polyamic acid. The body 10 comprises a rear portion 11 and a front portion 13 that surround a reservoir 12 adapted to receive and dispense an adhesive viscous liquid, such as polyamic acid 24. The reservoir 12 is essentially an opening extending from the top surface 10*a* through the body 10 to a substantially planar bottom surface 31 of the body 10. When the bottom surface 31 of the body 10 engages a horizontal planar application surface 26, the application surface 26 forms the bottom of the reservoir 12 which will contain an adhesive viscous liquid In the preferred embodiment of the invention, there are finger grooves 20 and 21 on the front surface 6 and rear surface 7, respectively, of the body 10 to aid in gripping the viscous liquid screed 1 when propelling it manually across the application surface 26. Alternatively, there may only be a finger groove 20 on the front surface 6 or the rear surface 7 of the body 10 or no groove at all.

Figure 2:
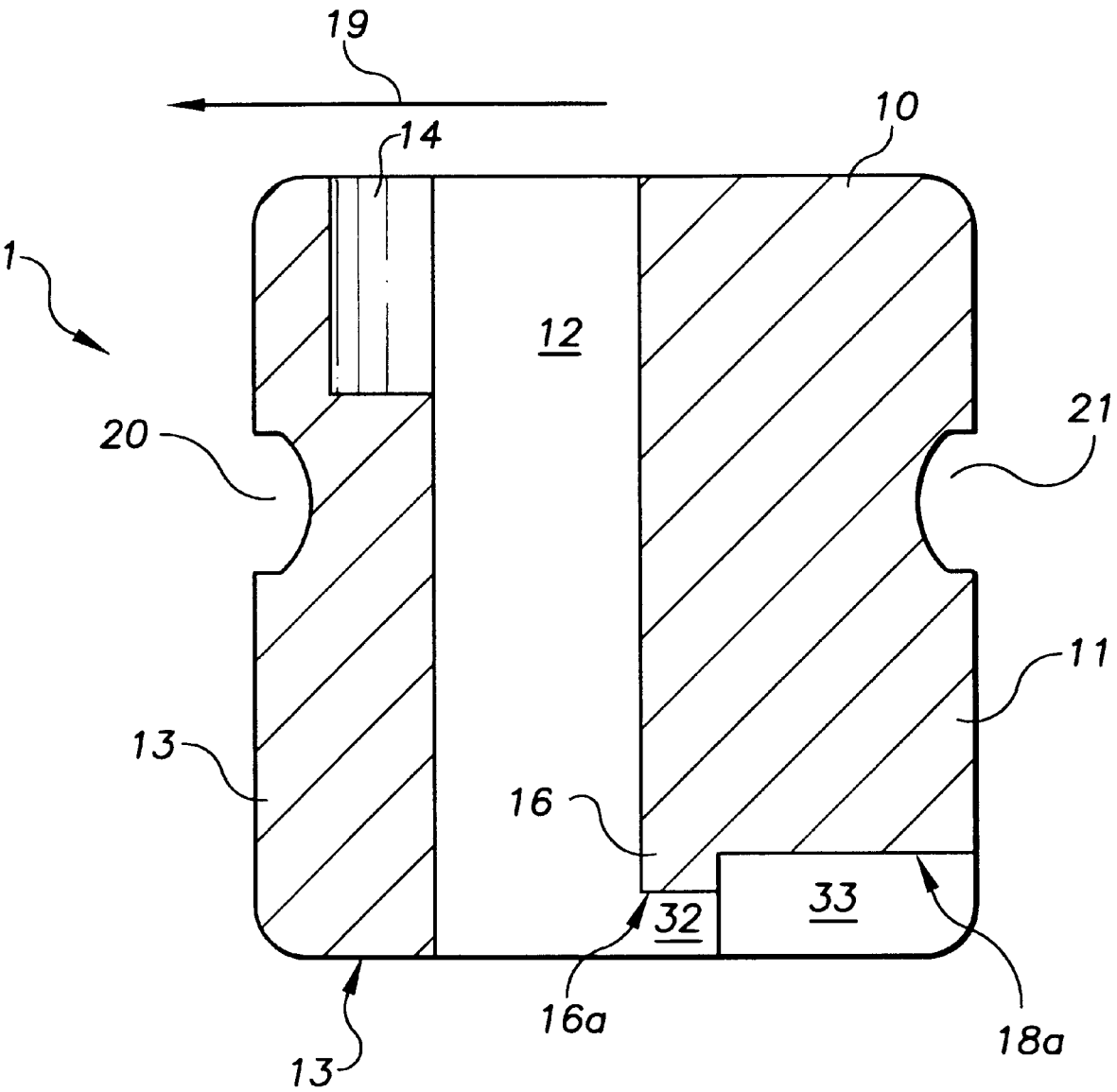
FIG. 2 is a cross sectional elevation of the screed taken along line 2—2 of FIG. 1.

In the preferred embodiment of the invention, there is a series of gage notches 14 located at intervals along the inside perimeter of the top surface 10*a* of the body 10. The gage notches 14, which are drilled, machined or the like in a preferably semi-circular shape, as shown in FIGS. 1 and 2, are in communication with the reservoir 12 and extend downward from the top surface 10*a* predetermined distances into the front portion 13 of the body 10. The gage notches 14 may also be located along the inside perimeter of the top surface 10*a* at the rear portion 11 of the body 10.

Each gage notch 14 is machined to a different predetermined depth such that when the reservoir 12 is filled to a level relative to the bottom of a specific gage notch 14, a predetermined amount of polyamic acid 24 is provided. The predetermined amount of polyamic acid 24 in the reservoir 12 corresponds to a predetermined length of film 24*a* of liquid polyamic acid 24 which will be provided when the screed 1 is propelled across the application surface 26 until the reservoir 12 is emptied. The length of the sheet that will be produced depends not only on the depth to which the reservoir 12 is filled, but also on the thickness of the film 24*a* and the width of the sheet produced.

For example, a screed 1 may contain five gage notches 14 of varying depths. The gage notch 14 with the greatest depth measured from the top surface 10*a* of the body 10 corresponds to the lowest fill level of the reservoir 12. The gage notch 14 with the least depth measured from the top surface 10*a* of the body 10 corresponds to the highest fill level of the reservoir 12. Thus, when the reservoir 12 is filled with polyamic acid 24 to the bottom of the first and deepest gage notch 14*a*, after propelling the screed 1 across the application surface 26 until the reservoir 12 is emptied, a 10 inch long thin sheet 24*a* of polyamic acid 24 may result, which is the shortest measured sheet for this example screed 1. If the reservoir 12 is filled to the bottom of the second gage notch 14*b*, a 12-inch long thin sheet 24*a* of polyamic acid 24 may result. Filling the reservoir 12 to the bottom of the third or fourth gage notches 14 may result in 14 inch or 16 inch long sheets 24*a*, respectively. Filling the reservoir 12 to the bottom of the fifth and highest gage notch 14, may result in an 18 inch long sheet 24*a* of polyamic acid 24, which is the longest sheet 24*a* for this example.

In an alternative embodiment of the invention, a predetermined length sheet 24*a* of polyamic acid 24 may be produced without using gage notches 14. The screed 1 may be designed such that reservoir 12 is unmarked and is filled to the top, or the reservoir 12 may be marked with lines or other gradations to meter the amount of polyamic acid 24 in the reservoir 12. Thus, filling the reservoir 12 to the top or to a predetermined level as marked by the gradations, and propelling the screed 1 across the application surface 26 until the reservoir 12 is empty will result in a predetermined length sheet 24*a* of polyamic acid 24.

Now referring to FIGS. 2 and 5: The bottom surface of the body 10 of the screed 1 is preferably provided with a planar surface 31 designed to engage and be propelled across a planar application surface 26. In the rear portion 11 of the body 10, there are recesses in the bottom surface 31 of the screed 1 which define orifices for the release of polyamic acid 24 from the reservoir 12. Extending downwardly from the rear portion 11 of the body 10 and adjacent the bottom portion of the reservoir 12 is a rib 16. The bottom surface 16*a* of the rib 16 is in fixed spatial relationship above the planar surface 31 thus providing a substantially rectangular first release orifice 22 between the application surface 26 and the bottom surface 16*a* of the rib 16, and bounded on the left and right by substantially vertical sides 32. In operation, the first release orifice 22 allows for release of the polyamic acid 24 from the reservoir 12 as shown in FIG. 5.

Figure 3:
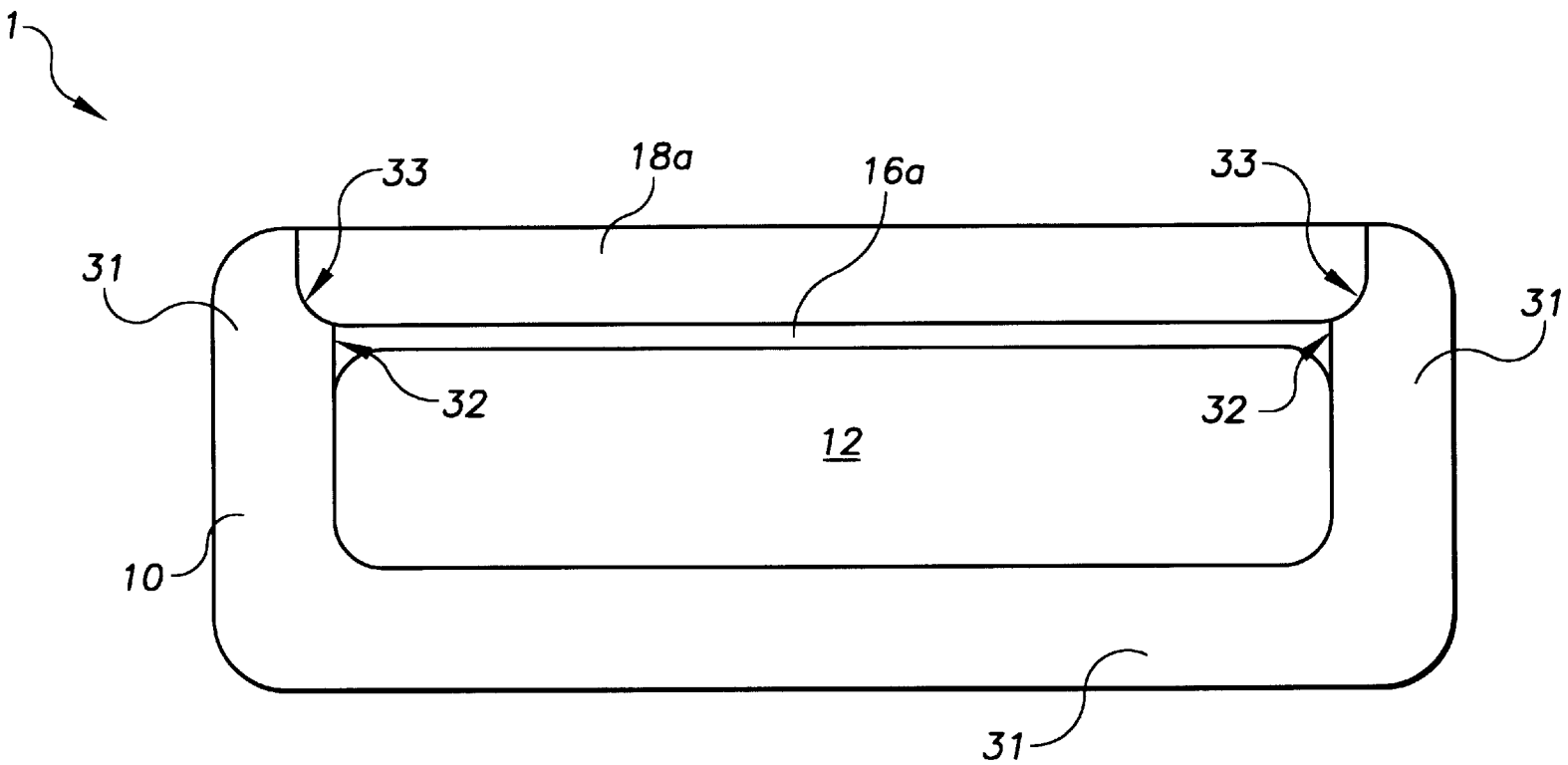
FIG. 3 is a bottom view of the screed shown in FIG. 1.
Figure 6:
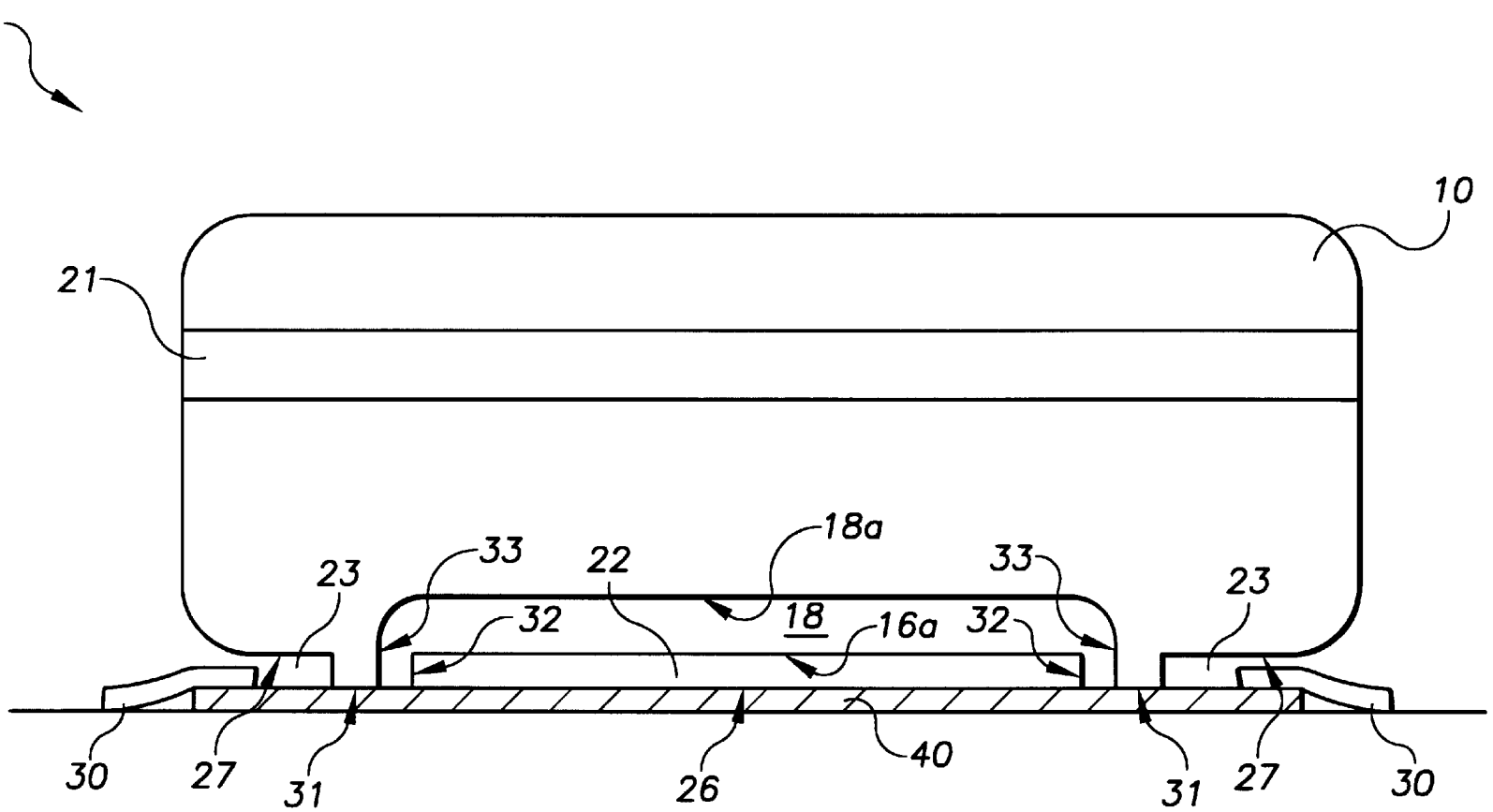
FIG. 6 is a rear view of an alternative embodiment of the invention.

Adjacent the first release orifice 22 is a second release orifice 18 whose upper surface 18*a* is higher than the bottom surface 16*a* of the rib 16 relative to the planar bottom surface 31, and therefore higher than the application surface 26, as shown in FIG. 5. The second release orifice 18 is bounded on the left and right by substantially vertical sides 33 which are closer to the left side 8 and right side 9 of the body 10 than are the sides 32 of the first release orifice 22, as shown in FIGS. 3 and 6.

In operation, the screed 1 is first placed so that the planar bottom surface 31 of the body 10 engages a planar horizontal application surface 26. Polyamic acid 24 is then poured into the reservoir 12 until the polyamic acid 24 reaches the bottom of the desired gage notch 14. The screed 1 is then propelled forward along application surface 26 in the direction of arrow 19. As the screed 1 is propelled forward, the pressure on the polyamic acid 24 due to gravity causes the polyamic acid 24 adjacent the first release orifice 22 to be forced out of the reservoir 12 and through the first release orifice 22. As the polyamic acid 24 is forced through the first release orifice 22, a thin film 24*a* of liquid polyamic acid 24 is formed. The height of the film 24*a* is determined by the distance between the application surface 26 and the bottom surface 16*a* of the rib 16 and the width of the film 24*a* is determined by the distance between the substantially vertical sides 32 of the first release orifice 22. The second release orifice 18 is of greater height and width than the first release orifice 22. The dimensions of the second release orifice 18 allow the polyamic acid 24 to be deposited on the application surface 26 as a thin sheet 24*a*, while preventing the bottom surface 31 of the screed 1 from contacting and disturbing the sheet of polyamic acid 24. The screed 1 is continually propelled along the application surface 26 until the reservoir 12 no longer contains any polyamic acid 24, thus providing a thin film 24*a* of liquid polyamic acid of predetermined dimensions.

As shown in FIG. 4, in an alternative embodiment of the present invention, clearance channels 23 may be provided along the left side 8 and right side 9 on the bottom surface 31 of the body 10 for ease of operation during the application of the polyamic acid 24 to the application surface 26. In this embodiment of the present invention, the application surface 26 is secured to a preferably flat fixed level object, such as a table or the like, using tape or similar securing means 30. The screed 1 is then placed on the application surface 26. The bottom surface 27 of the clearance channels 23 are in a fixed spatial relationship above the bottom planar surface 31 of the screed 1, and therefore above the application surface 26 as well as the securing means 30. As the screed 1 is propelled along the application surface 26, the planar bottom surface 31 of the screed 1 is prevented from coming into contact with the securing means 30 as a result of the clearance channels 23, thus allowing the planar bottom surface 31 of the screed 1 to maintain contact with the application surface 26, as shown in FIG. 6. This maximizes the surface area of the application surface 26 to which polyamic acid 24 can be applied.

The viscous liquid screed 1 described above advantageously provides a thin film 24*a* of liquid polyamic acid 24 of substantially uniform thickness on a glass plate 40. After the reservoir 12 is empty, the screed 1 is removed from the glass plate 40, and the glass plate 40 and thin film 24*a* are covered with a large metal container or other suitable covering (not shown). The cover is used to prevent dust contamination and/or air movement from affecting the thin film 24*a* of polyamic acid 24. The polyamic acid 24 is then allowed to dry at room temperature for 1 to 12 hours. A lamp (not shown) may be used to speed the drying process.

The glass plate 40 with the polyamic acid 24 is then placed in an oven (not shown). The internal temperature of the oven is then slowly stepped-up to a predetermined temperature above the glass-transition temperature of the polyamic acid 24, which is approximately 250° C., to drive off the solvent, typically NMP, in the polyamic acid 24, thus providing a thin sheet of solid adhesive. At each temperature "step", the temperature is maintained for a predetermined amount of time, before it is raised to the next temperature "step."

The following example will illustrate the above described process. This example is merely illustrative and intended to enable those skilled in the art to practice the invention in all of the embodiments flowing therefrom, and does not in any way limit the scope of the invention as defined by the claims. A liquid polyamic acid 24 solution was applied to a glass plate 40 using the viscous liquid screed 1, thereby providing a thin film 24*a* of 0.025" thick liquid polyamic acid 24. A closed metal container was placed over the glass plate as a protective cover for the film 24*a*, and the film was dried overnight at 60° C. The covered glass plate 40 and film 24*a* were then placed in an oven and dried at the following temperatures and time increments:

One hour at 100° C.;

one hour at 150° C.;

one hour at 200° C.;

one hour at 250° C.; and, one hour at 300° C.

The glass plate 40 and film 24*a* were then cooled slowly to prevent breakage of the glass 40.

The above described process resulted in a 0.001" to 0.002" thick sheet of solid polyamic acid with minimal amounts of NMP remaining. In an alternative embodiment of the present invention, the glass plate 40 and liquid polyamic acid 24 may only be heated to a temperature below the glass transition temperature of the polyamic acid 24, at which the NMP is not completely driven off.

These examples are merely illustrative and intended to enable those skilled in the art to practice the invention in all of the embodiments flowing therefrom, and do not in any way limit the scope of the invention as defined by the claims. Accordingly, the scope of the invention should be determined not by the embodiment illustrated, but by the appended claims and their legal equivalents.

What is claimed is:

1. A manually operable viscous liquid screed, comprising:

a body adapted to engage an application surface;

said body having a front portion, a rear portion, a front surface, a rear surface, a top surface, a substantially planar bottom surface, a right side and a left side;

said right side and said left side defining a first transverse width of said body;

said body front and rear portions being engageable by hand at said front and rear surfaces respectively;

said body having an opening extending from said top surface through said body to said substantially planar bottom surface;

said opening having a second transverse width which is less than said first transverse width;

whereby when said body contacts said application surface, said opening and said application surface define a reservoir adapted to receive a viscous fluid;

a first recess in the rear portion of said body extending upwardly from said planar bottom surface and adjacent to said opening;

said first recess having a first height;

said first recess having a third transverse width substantially equal to said second transverse width; said first recess being coextensive with said opening;

said first recess having a first left substantially vertical side and a first right substantially vertical side;

and a second recess in the rear portion of said body extending upwardly from said planar bottom surface;

said second recess being to the rear of and adjacent to said first recess and extending to said rear surface of said body;

said second recess having a second height greater than said first height;

said second recess having a fourth transverse width greater than said third transverse width and less than said first transverse width;

said second recess having a second left substantially vertical side and a second right substantially vertical side; and said second recess, said opening and said first recess defining a rib between said opening and said second recess, said rib having a rib bottom surface;

whereby when said body contacts said application surface, said first recess defines a substantially rectangular first release orifice;

and whereby when said body contacts said application surface, said second recess defines a second release orifice; and whereby when said reservoir contains said viscous fluid and said body is propelled across said application surface, said viscous liquid is forced by gravity through said first and second release orifices to deposit a layer of said viscous liquid on said application surface, the height of said layer of viscous liquid being defined by said rib bottom surface, and the width of said layer of viscous liquid being defined by said first left and right substantially vertical sides.

2. The viscous liquid screed of claim 1, further comprising a plurality of gage notches in said body and opening into said opening, each of said gage notches extending downward from said top surface of said body to a depth, whereby a volume of viscous liquid contained within said reservoir may be determined by comparison of a surface level of said viscous liquid contained within said reservoir to a depth of said gage notches.

3. The viscous liquid screed of claim 1, wherein said body is made of a material selected from the group consisting of aluminum, brass, steel, and solvent resistant polymers.

4. The viscous liquid screed of claim 1, further comprising a finger groove in said front surface of said body.

5. The viscous liquid screed of claim 1, further comprising a finger groove in said rear surface of said body.

6. The viscous liquid screed of claim 4, further comprising a finger groove in said rear surface of said body.

7. The viscous liquid screed of claim 1, wherein said first recess has a height of at least 0.025 inches relative to said planar bottom surface.

8. The viscous liquid screed of claim 1, further comprising a plurality of clearance channels extending upwardly from said substantially planar bottom surface, said clearance channels extending along said right side and said left side of said body, from said front surface to said rear surface;

each of said clearance channels extending transversely from said right side and left side and terminating before said second recess;

whereby when said substantially planar bottom surface engages said application surface, said clearance channels provide vertical spaces between said left and right sides of said body and said application surface.

* * * * *